United States Patent [19]

Bigham

[11] 4,390,115

[45] Jun. 28, 1983

[54] CAULKING GUN

[75] Inventor: Bobby J. Bigham, Arlington, Tex.

[73] Assignee: James M. Peppers, Houston, Tex.

[21] Appl. No.: 249,112

[22] Filed: Mar. 30, 1981

[51] Int. Cl.[3] ..... B67D 5/42

[52] U.S. Cl. ..... 222/326; 222/83; 222/83.5; 222/391; 83/580; 74/540

[58] Field of Search ..... 74/527, 540, 542; 124/1, 8, 31, 37, 74; 220/51, 277, 278, 293, 331; 222/80, 81, 82, 83, 83.5, 148, 149, 150, 151, 155, 325, 326, 327, 509, 391; 239/104, 106, 114, 569; 83/580; 30/2, 92, 96, 289; 7/129, 132

[56] References Cited

U.S. PATENT DOCUMENTS

| | | | |
|---|---|---|---|
| 1,421,317 | 6/1922 | Snell et al. | 74/542 |
| 2,801,775 | 8/1957 | Slobin | 222/236 |
| 3,105,614 | 10/1963 | Sherbondy | 222/82 |
| 3,406,875 | 10/1968 | Park | 222/151 |
| 4,135,644 | 1/1979 | Pacetti | 222/326 |
| 4,146,152 | 3/1979 | Ogawa et al. | 222/81 |
| 4,213,546 | 7/1980 | Massey | 222/326 |

*Primary Examiner*—Joseph J. Rolla
*Assistant Examiner*—Jan Koniarek

[57] ABSTRACT

Discloses a caulking gun apparatus including a caulking cartridge housing, a handle with a trigger attached to the housing, and a pawl system to ratchet a plunger rod and displacement head into the inlet of a caulking cartridge. A plunger rod release mechanism is provided which can be actuated by the operator while the caulking gun is held and operated with one hand. Mounted within the housing is a piercing blade and sealing mechanism for piercing the closure diaphram of the caulking cartridge and thereafter stopping the caulking cartridge to seal the caulking cartridge between the times that the caulking compound is extruded from the cartridge through its nozzle. A plurality of holes of different size as defined in the handle of the gun with the holes being oval or elliptical in shape and having their edges bevelled as to form a sharp edge on the inner side of the handle to act as a shear with a cooperating edge of the trigger when depressed into the handle. Such shearing holes are oval shaped so as to receive and fit the round plastic caulking cartridge nozzle at a visually appropriate acute angle whereby the tip of the sealed nozzle can be inserted into a hole of appropriate size and the trigger depressed into the handle to shear the tip off to a proper outlet size and angle. The shearing edges of the nozzle holes are preferably hardened such as by flame hardening.

12 Claims, 6 Drawing Figures

10
18
20
22
24
26
36
38
70
72
74
76
78
80
82
84
86
88
90a
90b
92
92a
94
5
6

CAULKING GUN

This invention generally relates to caulk application guns of the type to use expendable caulking compound cartridges and which has a single hand release feature to release pressure on the caulking gun cartridge during any time that the caulking gun is in use.

BACKGROUND OF THE INVENTION

Caulking guns of the nature disclosed herein are disclosed in U.S. Pat. No. 4,213,546, which shows such a caulking gun with an improved cap for the cartridge nozzle, and U.S. Pat. No. 4,135,644 which shows such a caulking gun having a cartridge nozzle cutting hole in its handle and also having a cartridge puncturing tool retractably mounted in its handle.

OBJECTS OF THE INVENTION

One object of the present invention is to provide a caulking gun having a side actuated release mechanism, which can be actuated by the same hand which is holding the gun, for taking the pressure off the caulking cartridge at any time and thereby prevent dripping of the caulking compound after the operator has released the trigger and wishes to withdraw the gun from the site where the caulking compound is being applied.

Another object of the present invention is to provide a mechanism which is contained with the caulking gun which will cut the tapered tip of the caulking cartridge nozzle to an appropriate diameter and also cut such tip at an angle favored by the operator for optimum placement of caulk from the gun.

A further object of the invention is to provide a caulking gun having a self-contained mechanism for piercing the closure diaphragm of a caulking cartridge after its placement in the gun body and thereafter sealing the tip of the caulking gun to insure that the caulking compound will not become dried out or too stiff to be moved out of the gun when the caulking operation is resumed.

SUMMARY OF THE INVENTION

The foregoing and other objects are attained by a caulking gun apparatus including a caulking cartridge housing, a handle with a trigger attached to the housing, and a pawl system to ratchet a plunger rod and displacement head into the inlet of a caulking cartridge. A plunger rod release mechanism is provided which can be actuated by the operator while the caulking gun is held and operated with one hand. A piercing blade and sealing mechanism for piercing the closure diaphram of the caulking cartridge and thereafter stopping the caulking cartridge to seal the caulking cartridge between the times that caulking compound is extruded from the cartridge through its nozzle is mounted with the housing. Defined in the handle of the caulking gun are a plurality of holes of different size with the holes being oval or eliptical in shape and having their edges bevelled as to form a sharp edge on the inner side of the handle to act as a shear with a cooperating edge of the trigger when depressed into the handle. Such shearing holes are shaped so as to receive and fit the plastic caulking cartridge nozzle at an appropriate angle whereby the tip of the sealed nozzle can be inserted into a hole of appropriate size and the trigger depressed into the handle to shear the tip off for proper outlet size and angle. The shearing edges of the nozzle holes are preferably hardened by flame hardening.

DESCRIPTION OF THE PREFERRED EMBODIMENT

Figures 1, 2, 3:
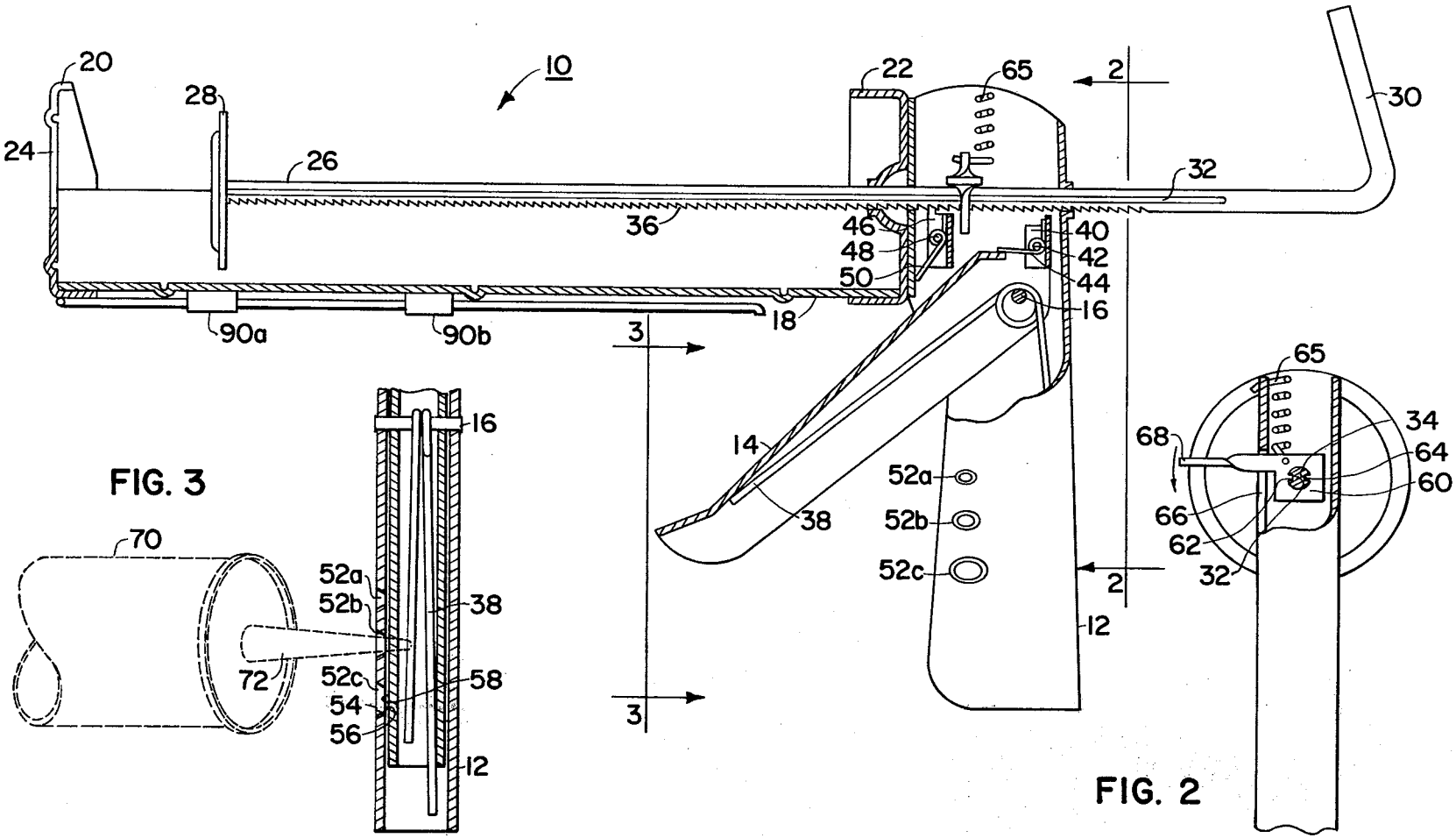
FIG. 1 is a partly schematic, partly longitudinal cross sectional view of a caulking gun of the present invention.
FIG. 2 is an end view of the caulking gun of FIG. 1 partly in cross section showing the pressure release mechanism of the present invention.
FIG. 3 is a sectional view taken along the lines 3—3 of FIG. 1 and showing the nozzle cut off holes as disposed with relation to the shearing edge of the trigger member.

Referring now to FIG. 1, there is shown the caulking gun of the present invention including a housing 10 attached to a handle 12 with a trigger 14 being mounted in pivoted relationship within handle 12 through a trigger pivot 16. The housing 10 is comprised of a semicylindrical cradle member 18 closed at its outlet end with a cup 20 and at its inner end with a cup 22.

Figures 4, 5, 6:
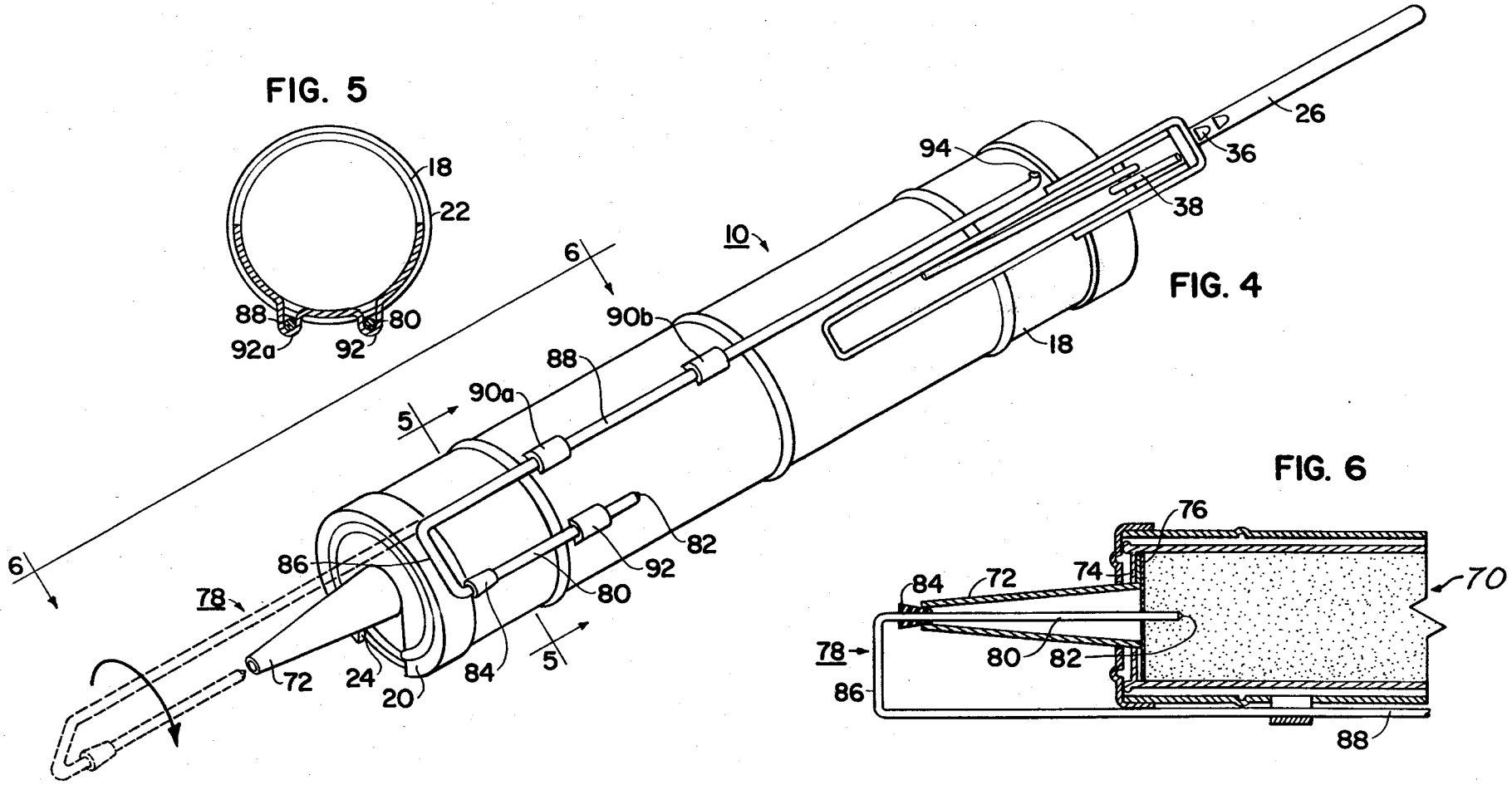
FIG. 4 is an isometric view of the gun of FIG. 1 showing the diaphram puncturing and sealing mechanism as mounted on the housing of the gun.
FIG. 5 is a section taken at line 5—5 of FIG. 4 and showing a swivel bracket and a retainer bracket of the piercing mechanism.
FIG. 6 is a cross sectional view of a caulking cartridge as has been pierced by the blade of the puncturing mechanism with the closure stopper and blade of the mechanism in sealing position.

The outlet cup 20 defines a slot 24 which laterally receives the nozzle of a caulking cartridge 70 such as partially shown in FIG. 6. The cups 20 and 22 are joined to the cradle 18 by means such as spot welding and the cup 22 is joined to the handle 12 by means such as spot welding.

The handle 12 is formed of sheet metal as by stamping and is formed in a generally U-shape as shown. The metal for the handle 12 may be a mild carbon steel suitable for stamping and also suitable to take some tempering by flame hardening as later mentioned.

Journaled through appropriate holes in the end cap 22 and the handle 12 is a plunger rod 26 extending within the housing 10 with a circularly shaped displacement head 28. In the absence of restraint, the plunger rod 26 is adapted to be moved longitudinally such that the displacement head 28 can traverse substantially the entire length of the cradle 18. At the outer end of the plunger rod 26, which extends from the handle 12, the rod 26 is bent in an angle to form a handle 30.

As can be seen in FIGS. 1 and 2, the plunger rod 26 has defined along its length keyway slots 32 and 34. Also defined along the length of the plunger rod 26 at approximately right angles to the slots 32 and 34 are a series of ramp-shaped ratchet teeth 36.

The trigger 14, also formed as by stamping into a U-shape and of metal similar to that of handle 14, is maintained in resiliently expanded position as shown in FIG. 1 by a trigger spring 38. Mounted within the U-shape body of trigger 14 at its upper end is a forwarding ratchet pawl 40 mounted about a pivot 42 and maintained in resiliently erect position, as shown in FIG. 1, by means of a pawl spring 44. Mounted within the U-shape of handle 12 as shown in FIG. 1 is a holding ratchet pawl 46 mounted within the handle 12 about a pivot 48 and maintained in ratcheting position as shown by means of a pawl spring 50.

The trigger 14, the pawls 40 and 46 and the ratchet teeth 26 are arranged such that successive squeezes of the trigger 14 causes the pawl 40 to forward the rod 26 into the cradle 18 a distance of at least one tooth of the ratchet teeth 36, and the rod 26 is maintained in this forwarded position by the holding ratchet pawl 46. Successive squeezes on the trigger 14 inches the displacement head 28 into the rear piston (not shown) of the cartridge 27 at least one tooth at a time and thereby forces caulking compound from within the cartridge 70 out through its nozzle 72 shown in FIG. 6.

Shown in the sides of the handle 12 in FIGS. 1 and 3 are a plurality of oval or elliptically shaped holes 52*a*, 52*b*, and 52*c* as shown. As examples, the holes 52 may be elliptical in shape with the axis of the ellipse disposed at 45° with respect to the side surface of the handle 12.

As can be seen in FIG. 3, the sides of the trigger 14 fit closely within the sides of the handle 12 such that a rear edge of the U-shape of the trigger 14 may be used as a cutting edge 58 with respect to the holes 52, assuming something is placed through the hole and the trigger is squeezed back to pass over a hole 52.

As best seen in FIG. 3, each of the holes 52*a*, 52*b*, and 52*c* is bevelled at an appropriate angle, 60° for example, such that the inner surface of the handle 12 forms, with the bevel, cutting edges 54*a*, 54*b*, and 54*c* which cutting edges will enhance the cutting action of the shearing edge of the trigger 14.

The purpose of the holes 52*a*, 52*b*, and 52*c*, in combination with the trigger 14, is to snip off the ends of the nozzles 72 of a cartridge 70 and also to snip off the end at a closely controlled angle such as provided by the elliptical shape of the holes. It is recognized that the tip of nozzle 72 could be placed into a round hole and be cut at an angle also, but in this instance, when the nozzle 72 is inserted into the snipping hole at the appropriate angle, then the exterior perimeter of the nozzle will match the elliptical edges of the respective hole, thus giving the operator a visual confirmation that the angle to be cut is proper.

During manufacture, the shearing edges 56 may be hardened, as by flame hardening, to insure that the edges 56 will remain sharp through the cutting of many plastic nozzles 72.

Now referring to FIGS. 1 and 2, there is shown a pawl release block 60 journalled about the plunger rod 26 and having internal dogs or keys 62 and 64 adapted to move in sliding splined relation within keyway slots 32 and 34. As arranged, such release block 60 may be slid along the rod 26 yet turn the rod at any place along the rod.

The block 60 defines an actuating lever 68 which extends through a slot 66 defined in the side of handle 12 so as to be readily accessible to the right thumb, for example, of the operator when the gun is in use and being squeezed by the hand of the operator.

The lever 68 and the release block 60 are retained by a spring 65 in a position permitting engagement of the ratchet teeth 36 with the ratchet pawls 42 and 46 during the normal operation of the caulking gun as the trigger is being repeatedly squeezed to forward the displacement head 28 into the caulking gun cartridge 70.

As can be seen with reference to FIGS. 1 and 2, downward movement of the lever 68 will rotate the release block 60 about the axis of the plunger rod 26 and also carry the plunger rod in rotation through the keys 62 and 64 in the keyway slots 32 and 34.

When the lever 68 is depressed to rotate the plunger rod 26, then the ratchet pawls 42 and 46 are rotated out of engagement with the ratchet pawls, allowing the plunger rod 26 and the displacement head 28 to move freely in a longitudinal direction. It is to be noted that releasement of the pawls 42 and 46 will also release any force exerted through the rod 26 and displacement head 28 into the cartridge 27, such that any pressure created within the cartridge 27 by the displacement head 28 is relieved and any tendency of caulk to drip out of the plastic nozzle 72 is thereby stopped.

Release of lever 68 at any time permits the spring 65 to rotate the plunger 26 back to the position shown in FIG. 1 with the pawls 42 and 46 again engaged with the ratchet teeth 36. This feature is important in that only one hand is necessary to release, then re-engage, the plunger rod 26 as described.

Referring now to FIGS. 4, 5, and 6, there is shown a partial longitudinal cross section of a caulking cartridge 70 having a plastic extrusion nozzle 72 retained on the cartridge with an inclosure 74. The interior of nozzle 72 is initially sealed from the caulking compound within the cartridge 70 by a closure diaphram 76.

A piercing and sealing mechanism 78 is provided to pierce and subsequently seal the diaphram 76 of the cartridge 70 is shown. The mechanism 78 includes a piercing blade 80 terminating in a point 82. A stopper seal 84 is disposed at the beginning of the blade 80. The blade 80 is formed with a support arm 86 in turn connected through a support shaft 88 as shown. The shaft 88 is supported in swivelled relation along the side of the cradle 18 by means of swivel support brackets 90*a* and 90*b*. At the end of the support shaft 88 is a shaft retainer 94 which prevents the shaft from coming completely out of the bracket 90*b*.

When in rest position, the mechanism 78 is retained with the blade 80 cradled within retainer bracket 92 as best shown in FIGS. 4 and 5. As can be seen with respect to FIG. 5 in particular, the brackets 90*a*, 90*b*, and 92 may be formed in the same stamping operation as forms the cradle 18.

OPERATION OF THE INVENTION

When caulking guns such as the present invention are used by a painter or carpenter, he usually knows what size and angle of application orifice that he wishes to have in the nozzle 72, which varies with the application in which the caulking compound is used.

In operation, the operator usually inserts the nozzle 72 in the appropriate shearing hole 52 to attain the desired orifice size and inclines the caulking gun 70 at an angle such that the exterior round surface of the caulking nozzle fits within the oval or elliptical shape of the particular cutting hole 52 as shown. When such match is visually made, the caulking nozzle is then positioned at substantially the desired shearing angle for the caulking application.

The trigger 14 is then squeezed to compress the trigger spring 38 and bring the trigger edge 58 across the respective hole 52 and thereby force the nozzle 72 into cutting contact with the appropriate shearing edge 56. The sealed end of the nozzle 72 is thereby cut off at the appropriate application angle.

After the end of the nozzle 72 has been clipped off at the appropriate angle as described, the cartridge 70 is placed into the housing cradle 18 between the end caps 20 and 22 with the nozzle 72 extending through the cap slot 24. During this time, the plunger rod 26 and the displacement head 28 have been pulled into fully retracted position.

The rod 26 is rotated by the rod handle 30 to a position such that the ratchet teeth 36 extend downwardly into ratcheting connection with the forwarding ratchet pawl 40 and the holding ratchet pawl 46 and pushed with a ratcheting action into the displacement piston (not shown) of the caulking cartridge 70.

The piercing apparatus 78 is then pulled free of the retaining bracket 92 and extended such that the point 82 of the blade 80 may be inserted into the open end of the application nozzle 72. The blade 80 is thereon pushed by means of the support arm 86 into the nozzle to a position where the point 82 has pierced the closure diaphram 76 of the cartridge 70. The blade 80 is thereon retracted and the mechanism 78 is rotated about the return the blade 80 into its retainer bracket 92.

The caulking gun is then ready for use and may be used by pulling the squeeze trigger 14 successively to ratchet the plunger rod and displacement head into the cartridge 70 and therey displace the caulking compound out through the nozzle 72 to the site where the caulking compound is to be applied.

At any time during the caulking operation, and while caulking compound remains in the cartridge 70, the lever 68 may be pulled from the horizontal position shown in FIG. 3 downwardly to the lower end of the slot 66 which causes the release block 60 and its keys 62 and 64 to rotate the shaft 26 around corresponding to such downward movement. Such downward movement causes the ratchet teeth 36 to be rotated out of registry with the holding ratchet pawl 46 and also the forwarding ratchet pawl 40. The release of the ratchet teeth 36 from the holding ratchet pawl 46 relieves and releases any force extended through the plunger rod 26 and displacement head 28 on the caulking compound within the cartridge 70.

Thus, if an operator wishes to pause in the caulking operation, he may pull the lever 68 down to relieve the pressure on the caulking compound and then remove the gun from its caulking position without caulking compound continuing to leak out from the nozzle 72, as happens in the prior art, with the attendant spillage of the caulking compound which may require subsequent clean up to prevent damage or disfigurement. This feature in itself is considered to be a significant contribution of the present invention.

Should the operator desire to resume the caulking operation, release of the lever 68 allows spring 65 to return the plunger rod 26 to engaged position for successive ratcheting by squeeze trigger 14.

At such time as the operator wishes to discontinue use of the caulking gun at any time while caulking compound remains in the caulking cartridge 70, he may pull the sealing and piercing mechanism 78 out from its retainer and insert the blade 80 back into the nozzle 72 to a position where the sealing stopper 84 closes off the end of the nozzle 72 and the point of the blade has reentered the interior of the cartridge 70 through the diaphram 76. Thus, a double seal is effected, the seal of the stopper 84 in the nozzle 72, and also the seal of the blade 80 in the diaphram 76.

Also to be noted as being of considerable importance is that the blade 80 extends through the residual caulking compound within the nozzle 72 at all times that the caulking gun is not in use. Thus, when the blade 80 and stopper 84 is withdrawn and returned to rest position as shown in FIG. 5, there remains an initial hole made from the blade 80 through the caulking compound in the nozzle 72 and the diaphram 76 into the cartridge 70. Thus, if caulk has tended to cake up within the nozzle 72, the operation of the caulking gun will permit caulking compound to come through the hole left by the withdrawn blade 80 and into caulking application even though the caulking compound may be caked and slightly stiffened.

In summary, the present invention provides three definite advantages over the prior art:

1. The release mechanism provided including the release block 60 and lever 68 provides for release of pressure on the caulking compound at any time while the operator has the gun in one hand such as when he is caulking overhead, for example. Also, only release of lever 68 is required to return the gun to operational condition.

2. The nozzle 72 may be accurately sheared at an appropriate angle and at an appropriate size at holes 52 more readily than with the known prior art.

3. The piercing and sealing mechanism 78 remains with the gun at all times, seals the caulking compound when not in use, and permits ready re-use of the gun without the consequence of caulk being plugged up in the nozzle 72.

Though only one of the embodiment of the invention is herein disclosed, it will become apparent to those skilled in the art that alterations and modifications can be made, all coming within the purview of the appended claims.

I claim:

1. A hand operated caulking gun having a housing, a U-shaped handle attached with said housing, a U-shaped squeeze trigger mounted about a pivot in said handle with pawl means to ratchet a plunger rod and a displacement head into the inlet of a caulking cartridge disposed in said housing, comprising:

(a) single hand actuated release means of construction suitable for rotating said plunger rod out of engagement with said pawl means while said gun is held solely by said single hand to release any force imposed by said rod against said displacement head;

(b) a piercing blade and seal means mounted in swiveled relation about the outlet end of said housing for piercing the closure diaphram of the caulking cartridge and thereafter sealing said caulking cartridge nozzle and said diaphram to seal the cauking cartridge between the occasions that caulking compound is extruded from said cartridge through said nozzle;

(c) a plurality of cutting holes of different size defined in said handle with said holes being generally oval in shape and having edges bevelled toward the inside to form a sharp edge on the inner side of the handle to form a sharp shear with a cooperating edge of said trigger when said trigger is depressed into said handle and with said shearing hole being oval shaped so as to receive and visually fit the round plastic caulking cartridge nozzle at an appropriate caulk dispensing angle; and (d) said shearing edges of said cutting holes being flame hardened.

2. The caulking gun of claim 1 further comprising:

(a) said piercing blade adapted to extend into said opened outlet nozzle, any caulking compound, and through said seal diaphram; and (b) a swivel support means in connection with said housing for supporting said piercing blade from a retracted stored position against said housing to extension of said blade to a position for entering said nozzle, to movement of said blade into said nozzle and through said diaphram, and to the return of said blade to said stored position.

3. The caulking gun of claim 2 further comprising:

(a) said seal means mounted on said blade and adapted to seal the outer opening of said outlet nozzle when said blade is fully extended into said nozzle.

4. The caulking gun of claim 1 wherein said release means comprises:

(a) a release block means mounted with said gun in sliding splined relation on said plunger rod for rotating said plunger rod out of connection with said pawl means when moved from a first position to a second position;

(b) spring means connected between said gun and said release block means to maintain said release block means in said first position and to return said release block means to said first position after movement; and (c) lever means extending from said release block means to be actuated by same said hand which is holding said gun.

5. In combination with caulking gun having a housing, a U-shaped handle attached with said housing, a U-shaped squeeze trigger mounted about a pivot in said handle with pawl means to ratchet a plunger rod and a displacement head into the inlet of a caulking cartridge disposed in said housing, comprising:

(a) a plurality of cutting holes of different size defined in said handle with said holes being generally oval in shape and having edges bevelled inwardly toward the inside of said handle to form a sharp edge on the inner side of the handle to form with a cooperating edge of said trigger a sharp shear when said trigger is depressed into said handle;

(b) with said shearing hole being oval shaped so as to receive and visually fit the round plastic caulking cartridge nozzle at an appropriate caulk dispensing acute angle.

6. The caulking gun of claim 5 wherein said shearing edges of said cutting holes are flame hardened.

7. In combination with hand held type caulking gun having a housing, a U-shaped handle attached with said housing, a U-shaped squeeze trigger mounted about a pivot in said handle with pawl means to ratchet a plunger rod and displacement head into the inlet of a caulking cartridge disposed in said housing, a single hand actuated release means for rotating said plunger rod out of engagement with said pawl means while said gun is held by said single hand to release any force imposed by said rod against said displacement head comprising:

(a) a release block means mounted with said gun in sliding splined relation on said plunger rod for rotating said plunger rod out of connection with said pawl means when moved from a first position to a second position; and (b) spring means connected between said gun and said release block means to maintain said release block means in said first position and to return said release block means to said first position after movement.

8. The caulking gun of claim 7 also including lever means extending from said release block means to be actuated by said same hand which is holding said gun.

9. A caulking gun having a housing, a U-shaped handle attached with said housing, a U-shaped squeeze trigger mounted about a pivot in said handle with pawl means to ratchet a plunger rod and displacement head into the inlet of a caulking cartridge disposed in said housing comprising a piercing blade and seal means mounted at the outlet end of said housing for piercing the closure diaphram of the caulking cartridge and thereafter sealing the caulking nozzle and said diaphram of said cartridge to seal the caulking cartridge between the occasions that caulking compound is extruded from said cartridge through said nozzle including:

(a) a piercing blade adapted to extend into the opened outlet nozzle and through the seal diaphram; and (b) a swivel support means in connection with said housing for supporting said piercing blade from a retracted stored position against said housing to extension of said blade to a position for entering said nozzle, to movement of said blade into said nozzle and through said diaphram, and to the return of said blade to said stored position.

10. The caulking gun of claim 9 wherein said seal means is mounted on said blade and adapted to seal the outer opening of said outlet nozzle when said blade is fully extended into said nozzle.

11. The caulking gun of claim 7 further including:

(a) a piercing blade adapted to extend into the opened outlet nozzle and through the seal diaphram of said cartridge; and (b) a swivel support means in connection with said housing for supporting said piercing blade from a retracted stored position against said housing, to extension of said blade to a position for entering said nozzle, to movement of said blade into said nozzle and through said diaphram, and to the return of said blade to said stored position.

12. The caulking gun of claim 11 also including a seal means mounted on said blade and adapted to seal the outer opening of said outlet nozzle when said blade is fully extended into said nozzle.

* * * * *